US008231069B2

(12) United States Patent
Matsumura et al.

(10) Patent No.: US 8,231,069 B2
(45) Date of Patent: Jul. 31, 2012

(54) FUEL INJECTION NOZZLE

(75) Inventors: Eriko Matsumura, Susono (JP); Tomojiro Sugimoto, Susono (JP); Motonari Yarino, Suntoh-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 521 days.

(21) Appl. No.: 12/227,437

(22) PCT Filed: May 18, 2007

(86) PCT No.: PCT/IB2007/001289

§ 371 (c)(1),
(2), (4) Date: Nov. 18, 2008

(87) PCT Pub. No.: WO2007/135526

PCT Pub. Date: Nov. 29, 2007

(65) Prior Publication Data

US 2009/0230219 A1 Sep. 17, 2009

(30) Foreign Application Priority Data

May 19, 2006 (JP) ..... 2006-139906

(51) Int. Cl.
*F02M 61/00* (2006.01)

(52) U.S. Cl. ..... 239/533.12; 239/533.2; 239/533.3; 239/585.4; 239/533.11; 239/596; 239/518

(58) Field of Classification Search ..... 239/5, 596, 239/533.2, 533.3, 533.12, 583, 584, 584.4, 239/584.5, 499, 518, 524, 533.11
See application file for complete search history.

(56) References Cited

U.S. PATENT DOCUMENTS

| | | | | |
|---|---|---|---|---|
| 4,699,323 | A * | 10/1987 | Rush et al. | 239/544 |
| 5,484,108 | A | 1/1996 | Nally | |
| 5,577,481 | A * | 11/1996 | Wahba | 123/470 |
| 5,772,124 | A * | 6/1998 | Tamaki et al. | 239/533.12 |
| 5,785,254 | A | 7/1998 | Zimmermann et al. | |
| 5,899,390 | A | 5/1999 | Arndt et al. | |
| 6,357,677 | B1 * | 3/2002 | Ren et al. | 239/585.4 |
| 6,405,946 | B1 * | 6/2002 | Harata et al. | 239/533.12 |
| 6,678,955 | B2 * | 1/2004 | Takeshita et al. | 29/890.142 |
| 6,742,727 | B1 * | 6/2004 | Peterson, Jr. | 239/533.3 |
| 6,817,545 | B2 | 11/2004 | Xu | |
| 6,848,635 | B2 * | 2/2005 | Xu | 239/533.12 |
| 6,915,968 | B2 * | 7/2005 | Abe et al. | 239/585.1 |

(Continued)

FOREIGN PATENT DOCUMENTS

JP A-01-271656 10/1989

(Continued)

*Primary Examiner* — Len Tran
*Assistant Examiner* — Trevor E McGraw
(74) *Attorney, Agent, or Firm* — Oliff & Berridge, PLC

(57) ABSTRACT

In a fuel injection nozzle for an internal combustion engine, a first cavity is disposed downstream of a valve seat in a direction in which fuel flows. A second cavity is disposed downstream of the first cavity in the direction in which the fuel flows. A fuel passage connects the first cavity to the second cavity. Fuel injection holes (24) lead to the second cavity. With this configuration, when the fuel flows through the first fuel passage, cavitation is induced. Cavitation bubbles flow into the second cavity along with the fuel. When the fuel is retained in the second cavity, the cavitation bubbles are uniformly mixed into the fuel. The fuel, which has been sufficiently mixed with the cavitation bubbles, is injected from the fuel injection holes.

6 Claims, 4 Drawing Sheets

U.S. PATENT DOCUMENTS

| | | | | |
|---|---|---|---|---|
| 6,966,499 | B2 * | 11/2005 | Nally et al. | 239/5 |
| 7,003,880 | B2 * | 2/2006 | Morita | 29/890.142 |
| 7,104,475 | B2 * | 9/2006 | Goenka et al. | 239/533.2 |
| 7,124,963 | B2 * | 10/2006 | Goenka et al. | 239/504 |
| 7,137,577 | B2 * | 11/2006 | Goenka et al. | 239/533.12 |
| 7,198,207 | B2 * | 4/2007 | Goenka et al. | 239/533.12 |
| 2003/0127540 | A1 | 7/2003 | Xu | |
| 2005/0121543 | A1 * | 6/2005 | Sayar | 239/533.12 |
| 2005/0284965 | A1 * | 12/2005 | Schneider | 239/533.12 |
| 2006/0097082 | A1 | 5/2006 | Goenka et al. | |

FOREIGN PATENT DOCUMENTS

| | | |
|---|---|---|
| JP | A-2003-206828 | 7/2003 |
| JP | A-2004-316598 | 11/2004 |
| WO | WO 95/27136 | 10/1995 |

* cited by examiner

FUEL INJECTION NOZZLE

BACKGROUND OF THE INVENTION

1. Field of the Invention

The invention relates to a fuel injection nozzle of an internal combustion engine. More specifically, the invention relates to a technology in which a fuel injection nozzle induces cavitation to atomize injected fuel.

2. Description of the Related Art

The atomization of fuel injected from a fuel injection nozzle is effective for reducing the amount of pollutants in exhaust gas, and improving fuel efficiency. Japanese Patent Application Publications No. 2003-206828 (JP-A-2003-206828) and No. 2004-316598 (JP-A-2004-316598) describe that cavitation is induced in fuel in a fuel injection nozzle, and the fuel mixed with cavitation bubbles is injected.

In the technology described in the publication No. 2003-206828, an edge protrusion that protrudes into the flow of fuel is formed at the edge of a valve seat. The flow of fuel is separated from the valve seat by the edge protrusion. As a result, cavitation is induced. The edge protrusion is disposed immediately upstream of an injection hole. Therefore, cavitation bubbles generated by the edge protrusion flow into the injection hole, along with the fuel.

In the technology described in the publication No. 2004-316598, a plurality of injection-hole inlet passages, which extends from a valve seat, is formed in a nozzle body. The downstream ends of the injection-hole inlet passages are connected to each other by a communication passage. A plurality of injection-port outlet passages is also formed in the nozzle body. The injection-port outlet passages extend from the communication passage to respective injection outlets formed on the outer surface of the nozzle body. When the fuel flows from the valve seat to the injection outlets through the injection-hole inlet passages, the cavitation is induced in the injection-hole inlet passages. Further, the fuel that flows in the communication passage collides with the fuel that flows out of the injection-hole inlet passages at the inlet portions of the injection-hole outlet passages. The collision energy promotes the disturbance of the flow of fuel in the injection-hole outlet passages, and accordingly promotes the mixing of the cavitation bubbles into the flow of fuel.

However, in the technology described in the publication No. 2003-206828, because the cavitation is induced near the injection hole, the fuel may be injected before the fuel and the cavitation bubbles are sufficiently mixed with each other. In the technology described in the publication No. 2004-316598, because the injection-hole inlet passages extend directly from the valve seat, the occurrence of cavitation in the injection-hole inlet passages is greatly influenced by the flow passage area of a space between the valve seat and the needle valve. More specifically, when the needle valve has just moved away from the valve seat, the flow passage area of the space between the valve seat and the needle valve is small. Thus, the flow passage area of the space between the valve seat and the needle valve only slightly differs from the flow passage area of the injection-hole inlet passages. Therefore, when the fuel flows from the valve seat into the injection-hole inlet passages, the pressure of the fuel only slightly decreases. As a result, the cavitation may not be sufficiently induced in the injection-hole inlet passages.

Thus, the above-described conventional fuel injection nozzles need to be improved to sufficiently atomize the fuel.

US 2006/0097082 discloses a fuel injection nozzle with a needle valve and a valve seat. Fuel flows through a passage to a plurality of injection outlets. A rip causes in the exit cavity a cavitating flow region which enhances the atomization of the fuel.

SUMMARY OF THE INVENTION

The invention provides a fuel injection nozzle that injects the fuel that is sufficiently atomized.

A first aspect of the invention relates to a fuel injection nozzle that includes a plurality of injection outlets, a valve seat, a needle valve, a first cavity, a second cavity, a first fuel passage, and a plurality of second fuel passages. The valve seat is formed in a passage through which fuel flows to the plurality of injection outlets. The needle valve is seated on, or moved away from the valve seat. The first cavity is disposed downstream of the valve seat in a direction in which the fuel flows. The second cavity is disposed downstream of the first cavity in a direction in which the fuel flows. The first fuel passage connects the first cavity to the second cavity. The flow passage area of the first fuel passage is smaller than the flow passage area of the first cavity. Each of the plurality of second fuel passages connects the second cavity to a corresponding one of the plurality of injection outlets. The flow passage area of each of the plurality of second fuel passages is smaller than the flow passage area of the second cavity.

In the above-described aspect, each of the plurality of second fuel passages may be inclined with respect to a direction perpendicular to a direction in which the first fuel passage extends such that the downstream side of each of the plurality of second fuel passages is closer to the upstream side of the first fuel passage than the upstream side of each of the plurality of second passages is.

In the above-described aspect, the first cavity may be disposed on the axis of the needle valve. The second cavity may be disposed along a circle around the axis of the needle valve. The first fuel passage may extend from the peripheral surface of the first cavity in the radial direction of the needle valve.

In the above-described aspect, the fuel injection nozzle may further include a nozzle body in which the needle valve is housed, and the valve seat is formed; and a nozzle plate in which the plurality of injection outlets are formed. The first cavity may be formed by a first gap between the needle valve and the nozzle plate. The first fuel passage and the second cavity may be formed by a second gap between the nozzle body and the nozzle plate. The plurality of second fuel passages may be formed in the nozzle plate.

In the above-described aspect, the second gap may be disposed along a circle around the axis of the needle valve. The second gap may include a narrow gap, and a wide gap that is wider than the narrow gap and that is disposed outside the narrow gap in the radial direction. The first fuel passage may be formed by the narrow gap, and the second cavity may be formed by the wide gap.

In the above-described aspect, the narrow gap may be continuously formed along the circle around the axis of the needle valve.

In the above-described aspect, the wide gap may be continuously formed along the circle around the axis of the needle valve.

In the above-described aspect, the wide gap may include a plurality of wide gaps that are disposed at predetermined intervals along the circle around the axis of the needle valve. Each of the plurality of wide gaps may be connected to at least one of the plurality of injection outlets via the corresponding one of the plurality of second fuel passages.

In the above-described aspect, the second gap may be formed by a recessed portion and a protruding portion that are formed on the surface of the nozzle body, which faces the nozzle plate.

In the above-described aspect, after the fuel passes through the space between the needle valve and the valve seat, the fuel flows from the first cavity to the first fuel passage. Then, the fuel flows through the first fuel passage to the second cavity. When the fuel flows through the first fuel passage, cavitation is induced due to boiling under reduced pressure. Cavitation bubbles generated in the first fuel passage flows into the second cavity, along with the fuel. In the second cavity, the fuel and cavitation bubbles are mixed with each other. Then, the fuel mixed with the cavitation bubbles flows through the second fuel passages so that the fuel is injected from the injection outlets. Thus, after the fuel and cavitation bubbles are sufficiently mixed with each other, the fuel is injected. This promotes atomization of the injected fuel. Further, the fuel flows into the first fuel passage via the first cavity, instead of flowing into the first fuel passage directly from the space between the needle valve and the valve seat. This ensures that the cavitation is induced in the first fuel passage when the needle valve has just moved away from the valve seat.

In particular, each of the plurality of second fuel passages may be inclined with respect to the direction perpendicular to the direction in which the first fuel passage extends such that the downstream side of each of the plurality of second fuel passages is closer to the upstream side of the first fuel passage than the upstream side of each of the plurality of second passages is. In this case, the fuel does not smoothly flow from the second cavity into the second fuel passages after the fuel flows from the first cavity into the second cavity. This increases the time that the fuel is retained in the second cavity, and promotes the mixing of the cavitation bubbles and the fuel. Further, because each of the plurality of second fuel passages is inclined with respect to the direction perpendicular to the direction in which the first fuel passage extends such that the downstream side of each of the plurality of second fuel passages is closer to the upstream side of the first fuel passage than the upstream side of each of the plurality of second passages is, it is possible to reduce the likelihood that the first fuel passage will be blocked by deposits formed due to the inflow of combustion gas through the injection outlets. Accordingly, it is possible to reduce the likelihood that the mixing of the cavitation bubbles and the fuel is inhibited by deposits that adhere to the inside of the second cavity.

The first fuel passage and the second cavity may be formed by the second gap between the nozzle body and the nozzle plate. In this case, it is possible to easily form an entire passage through which the fuel flows from the space between the needle valve and the valve seat, to the injection outlets. Particularly, the second gap may be formed by a recessed portion and a protruding portion that are formed on the surface of the nozzle body, which faces the nozzle plate. In this case, the shape of the nozzle plate is simple, and the fuel injection nozzle is more easily formed.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF THE EXAMPLE EMBODIMENTS

Hereinafter, a first embodiment of the invention will be described with reference to FIG. 1 to FIG. 3.

Figure 1:
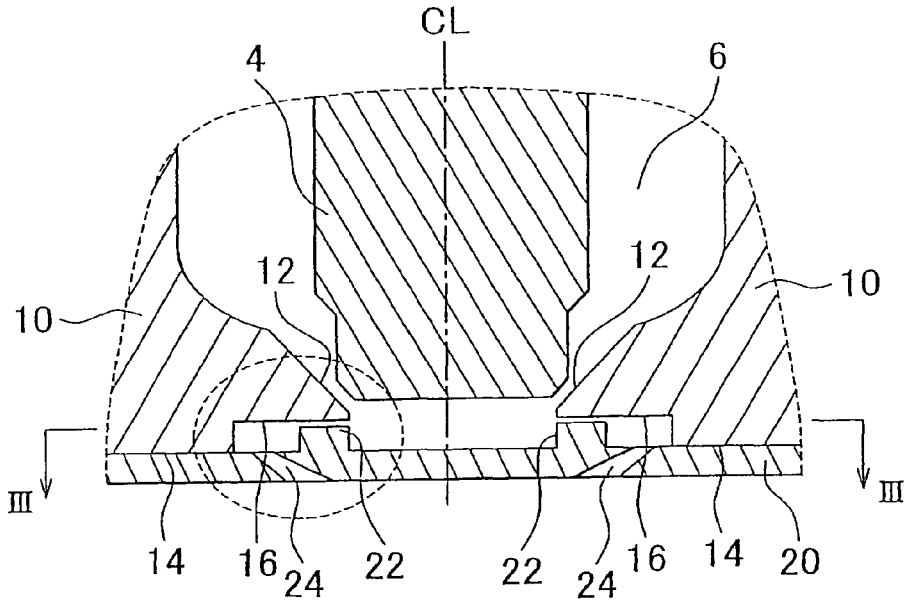
FIG. 1 is a cross sectional view showing the end portion of a fuel injection nozzle according to a first embodiment of the invention.

FIG. 1 is a cross sectional view showing the end portion of a fuel injection nozzle according to the first embodiment of the invention. The fuel injection nozzle according to the first embodiment includes a needle valve 4, a nozzle body 10 in which the needle valve 4 is housed, and a nozzle plate 20 attached to the nozzle body 10.

A fuel passage 6, through which fuel flows, is formed inside the nozzle body 10. Hereinafter, the fuel passage 6 will be referred to as "nozzle passage 6". The needle valve 4 is housed in the nozzle passage 6. The needle valve 4 reciprocates in the direction of the axis CL. A valve seat 12, on which the needle valve 4 is seated, is formed at the outlet of the nozzle passage 6. When the needle valve 4 moves away from the valve seat 12 in the direction of the axis CL, the outlet of the nozzle passage 6 opens, and fuel is supplied to the area downstream of the nozzle passage 6. When the needle valve 4 is seated on the valve seat 12, the supply of the fuel to the area downstream of the nozzle passage 6 is interrupted.

A flat surface (attachment surface) 14 is formed in the end portion of the nozzle body 10. The nozzle plate 20 is attached to the attachment surface 14. A recessed portion 16 is formed inside the attachment surface 14 in the nozzle body 10. The recessed portion 16 is cylindrical around the axis CL of the needle valve 4. The bottom of the recessed portion 16 is near the valve seat 12. When the needle valve 4 is seated on the valve seat 12, the end of the needle valve 4 does not protrude into the recessed portion 16, or slightly protrudes into the recessed portion 16.

A plurality of fuel injection holes 24 is formed in the nozzle plate 20. The plurality of fuel injection holes 24 functions as the plurality of second fuel passages. The fuel is injected through the plurality of fuel injection holes 24. Each fuel injection hole 24 extends from the surface of the nozzle plate 20, which faces the nozzle body 10, to the opposite surface of the nozzle plate 20. When the nozzle plate 20 is attached to the nozzle body 10, the inlet of each fuel injection hole 24 faces the recessed portion 16. Each fuel injection hole 24 is inclined at a predetermined angle in the radial direction of the needle valve 4 with respect to the axis CL of the needle valve 4.

A circular protruding portion 22 is formed on the surface of the nozzle plate 20, which faces the nozzle body 10. The protruding portion 22 is formed inside the inlets of the fuel injection holes 24. The outer diameter of the protruding portion 22 is smaller than the diameter of the recessed portion 16.

When the nozzle plate 20 is attached to the nozzle body 10, the protruding portion 22 is positioned on a circle around the axis CL of the needle valve 4. In other words, the protruding portion 22 is positioned inside the recessed portion 16. The inner diameter of the protruding portion 22 is substantially the same as the inner diameter of the valve seat 12. The height of the protruding portion 22 is slightly smaller than the height (depth) of the recessed portion 16. When the nozzle plate 20 is attached to the nozzle body 10, a narrow gap is formed between the top surface of the protruding portion 22 and the bottom surface of the recessed portion 16.

Figure 2:
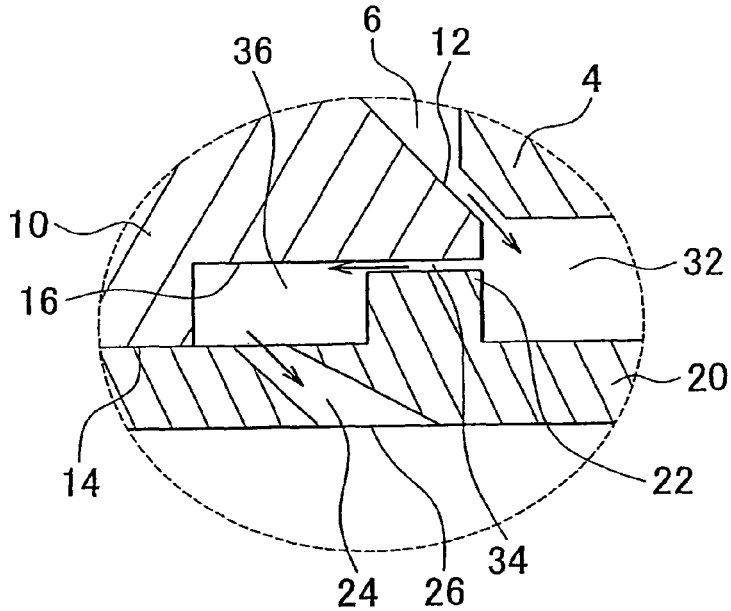
FIG. 2 is an enlarged cross sectional view showing a part of FIG. 1 (i.e., the oval area surrounded by the dashed line in FIG. 1)

FIG. 2 is an enlarged cross sectional view showing a part of FIG. 1 (i.e., the oval area surrounded by the dashed line in FIG. 1). As shown in FIG. 2, a cavity 32 is formed between the end of the needle valve 4 and the nozzle plate 20. The cavity 32 is surrounded by the inner peripheral surface of the protruding portion 22. A cavity 36 is formed between the nozzle body 10 and the nozzle plate 20. The cavity 36 is surrounded by the peripheral surface of the recessed portion 16 and the outer peripheral surface of the protruding portion 22. The cavity 32 is positioned upstream of the cavity 36 in the direction in which the fuel flows. Hereinafter, the cavity 32 will be referred to as "first cavity", and the cavity 36 will be referred to as "second cavity". A fuel passage 34 connects the two cavities 32 and 36 to each other. Thus, the fuel passage 34 functions as the first fuel passage. The fuel passage 34 is formed by a gap between the top surface of the protruding portion 22 and the bottom surface of the recessed portion 16. That is, the second cavity 36 is formed by the wide gap between the nozzle body 10 and the nozzle plate 20, and the fuel passage 34 is formed by the narrow gap between the nozzle body 10 and the nozzle plate 20.

Figure 3:
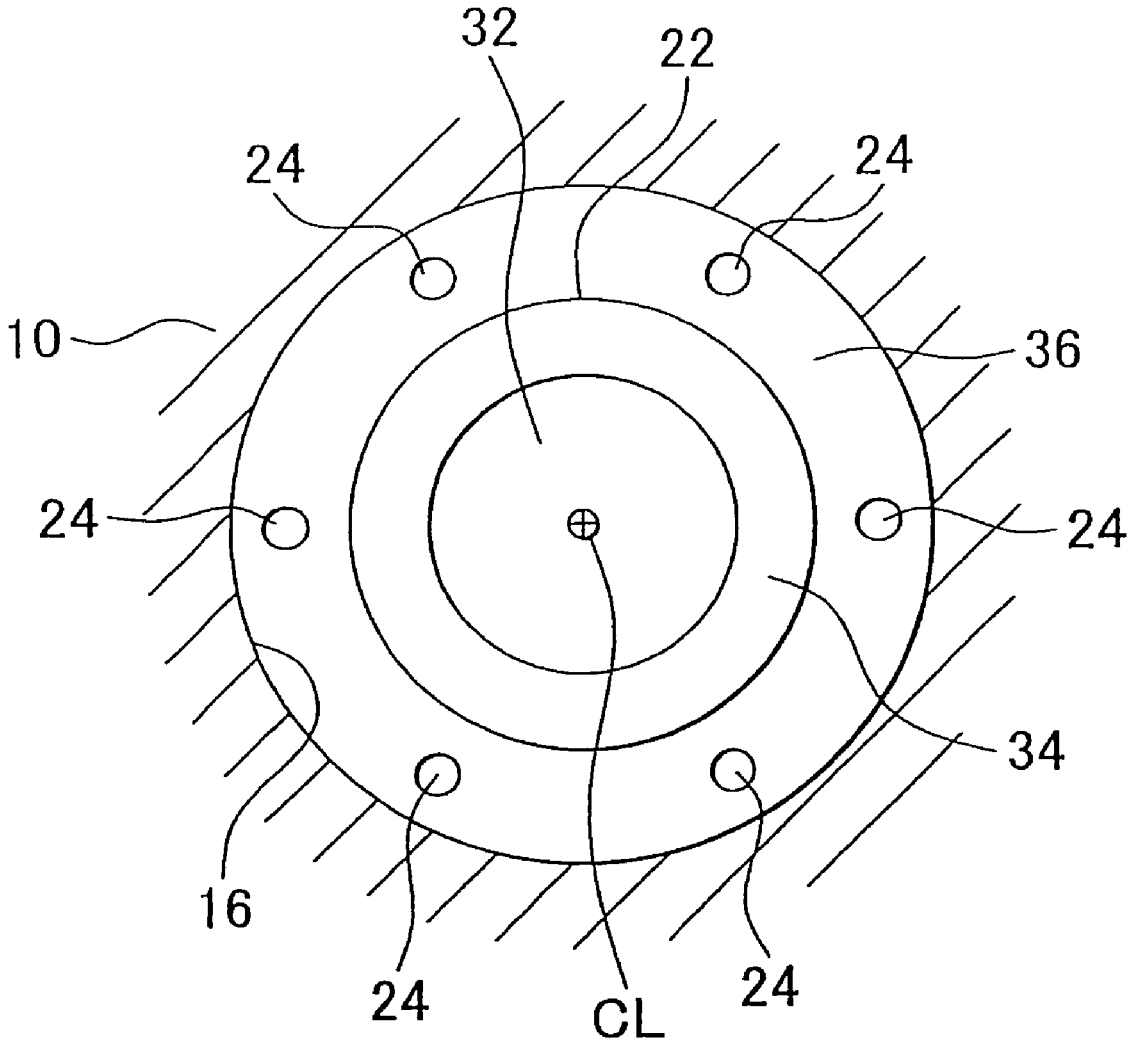
FIG. 3 is a cross sectional view taken along the line III-III in FIG. 1.

FIG. 3 is a cross sectional view taken along the line III-III in FIG. 1. As shown in FIG. 3, the first cavity 32 is a cylindrical space positioned on the axis CL of the needle valve 4. The second cavity 36 is a circular space around the axis CL of the needle valve 4. The fuel passage 34 is circular around the axis CL. The fuel passage 34 extends in the radial direction from the peripheral surface of the first cavity 32 to the inner peripheral surface of the second cavity 36.

The fuel injection holes 24 lead to the second cavity 36. As shown in FIG. 2, the fuel injection holes 24 connect the second cavity 36 to respective injection outlets 26 that are the outlets of the fuel injection holes 24. As shown in FIG. 3, the inlets of the fuel injection holes 24 are disposed at equal intervals on a circle around the axis CL of the needle valve 4.

Next, the action and effects of the fuel injection nozzle according to the first embodiment will be described with reference to FIG. 2. In FIG. 2, the arrow indicates the flow of the fuel when the needle valve 4 is away from the valve seat 12.

When the needle valve 4 moves away from the valve seat 12 in the direction of the axis CL, communication is provided between the nozzle passage 6 and the first cavity 32. Thus, the fuel flows from the nozzle passage 6 into the first cavity 2. Then, the fuel flows from the first cavity 32 into the fuel passage 34. The flow passage area of the fuel passage 34 is much smaller than the flow passage area of the first cavity 32. Thus, when the fuel flows into the fuel passage 34, the flow speed of the fuel is increased, and accordingly the pressure of the fuel is decreased. This decrease in the fuel pressure induces cavitation in the fuel passage 34.

The fuel flows from the fuel passage 34 into the second cavity 36 along with cavitation bubbles generated in the fuel passage 34. Then, the fuel flows from the second cavity 36 to the fuel injection holes 24 downstream of the second cavity 36. The flow passage area of the second cavity 36 is much larger than the flow passage area of each fuel injection hole 24. Therefore, the fuel is retained in the second cavity 36 for a while. Further, because each fuel injection hole 24 is inclined with respect to a direction perpendicular to a direction in which the fuel passage 34 extends such that the downstream side of each fuel injection hole 24 is closer to the upstream side of the fuel passage 34 than the upstream side of each fuel injection hole 24 is, the fuel does not smoothly flow from the fuel passage 34 to the fuel injection holes 24. This ensures that the fuel is retained in the second cavity 36 for a while. When the fuel is retained in the second cavity 36, the fuel and the cavitation bubbles mix with each other. Thus, the fuel, which has been sufficiently mixed with the cavitation bubbles, flows into the fuel injection holes 24.

Thus, in the fuel injection nozzle according to the first embodiment, after the fuel and the cavitation bubbles are sufficiently mixed with each other, the fuel is injected. This promotes atomization of the injected fuel. Further, in the fuel injection nozzle according to the first embodiment, the fuel flows into the fuel passage 34 via the first cavity 32, instead of flowing into the fuel passage 34 directly from the space between the needle valve 4 and the valve seat 12. This ensures that the cavitation is induced in the fuel passage 34 when the needle valve 4 has just moved away from the valve seat 12.

Further, in the fuel injection nozzle according to the first embodiment, because each fuel injection hole 24 is inclined with respect to the direction perpendicular to the direction in which the fuel passage 34 extends such that the downstream side of each fuel injection hole 24 is closer to the upstream side of the fuel passage 34 than the upstream side of each fuel injection hole 24 is, it is possible to reduce the likelihood that the fuel passage 34 is blocked by deposits formed due to the inflow of combustion gas through the injection outlets 26. Accordingly, it is possible to reduce the likelihood that the mixing of the cavitation bubbles and the fuel is inhibited by deposits that adheres to the inside of the second cavity 36.

The fuel injection nozzle according to the first embodiment also has an advantage relating to the production process. As described above, the fuel passage 34 and the second cavity 36 are formed by the gaps between the nozzle body 10 and the nozzle plate 20. Therefore, the entire passage from the nozzle passage 6 to the injection outlets 26 may be easily formed. Particularly, the fuel passage 34 needs to be formed by a narrow gap to effectively cause the cavitation. With the configuration of the fuel injection nozzle according to the first embodiment, it is possible to accurately form the narrow gap needed to effectively cause the cavitation.

Hereinafter, a second embodiment of the invention will be described with reference to FIG. 4.

Figure 4:
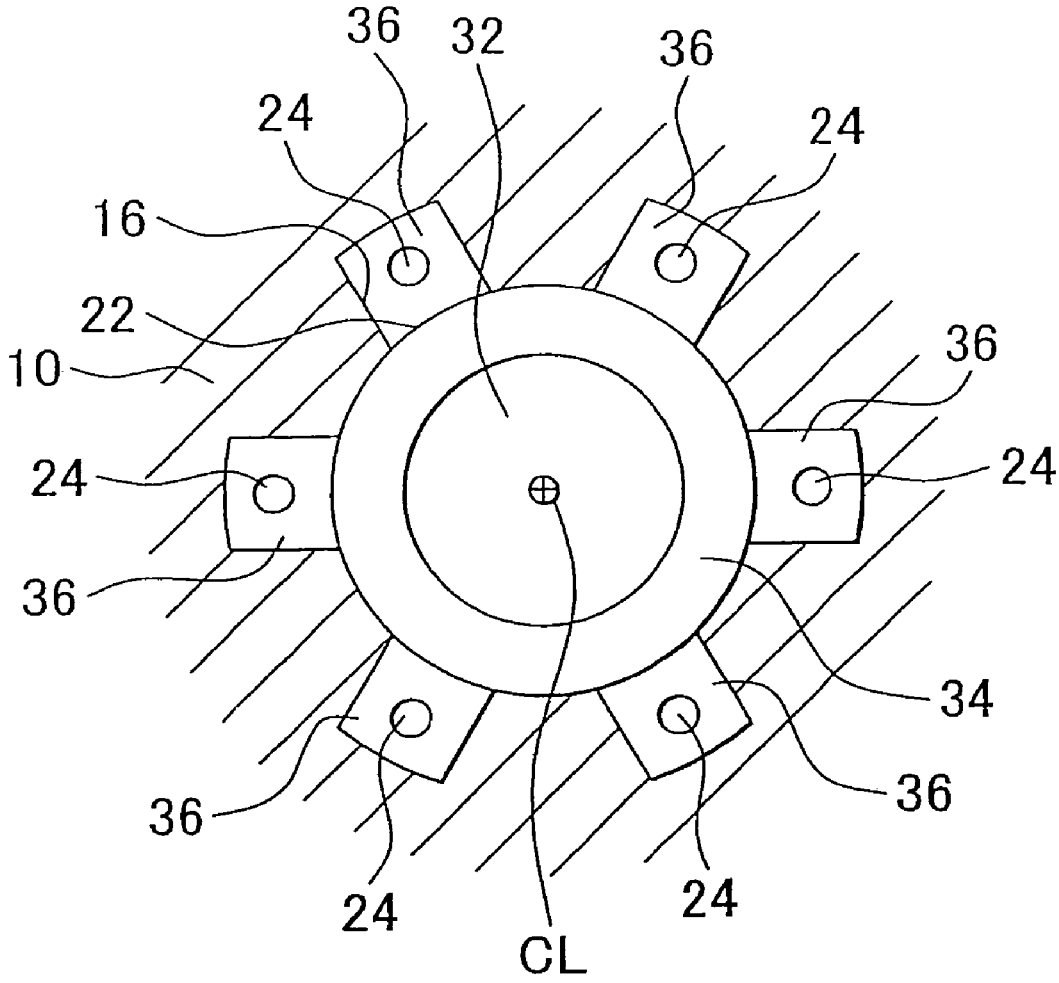
FIG. 4 is a cross sectional view showing the end portion of a fuel injection nozzle according to a second embodiment of the invention, which is similar to FIG. 3 that shows the fuel injection nozzle according to the first embodiment.

FIG. 4 is a cross sectional view showing the end portion of a fuel injection nozzle according to the second embodiment of the invention. FIG. 4 is similar to FIG. 3 in that it also depicts a cross sectional view of the fuel injection nozzle according to the first embodiment, which is taken along the line III-III in FIG. 1. In FIG. 4, the same components and portions as those of the fuel injection nozzle according to the first embodiment are denoted by the same reference numerals. Therefore, the redundant description thereof will be omitted.

The fuel injection nozzle according to the second embodiment differs from the fuel injection nozzle according to the first embodiment with respect to the configuration of the second cavity 36. In the second embodiment, separate second cavities 36 are provided for each fuel injection hole 24. The second cavities 36 are disposed at predetermined intervals along a circle around the axis CL of the needle valve 4. The second cavities 36 are formed by forming the recessed portion 16 of the nozzle body 10 in a gear shape as shown in FIG. 4, instead of forming the recessed portion 16 in the cylindrical shape as in the first embodiment. The base circle portion of the gear-shaped recessed portion 16 is fitted to the outer peripheral surface of the protruding portion 22. As a result, separate second cavities 36 are provided for each fuel injection hole 24.

With the above-described configuration, after the fuel flows from the first cavity 32 into the fuel passage 34, the fuel is distributed from the fuel passage 34 to each of the second cavities 36. Then, the fuel is supplied to the associated fuel injection holes 24. Thus, it is possible to reduce the dead volume of fuel in the second cavities 36 while maintaining the effect of promoting the mixing of the cavitation bubbles and the fuel in the second cavities 36. In the above-described configuration, the fuel passage 34 is circular as in the first embodiment. However, the fuel passages 34 may be separately provided for the respective fuel injection holes 24 when the second cavities 36 are separately provided for the respective fuel injection holes 24.

A third embodiment of the invention will be described with reference to FIG. 5.

Figure 5:
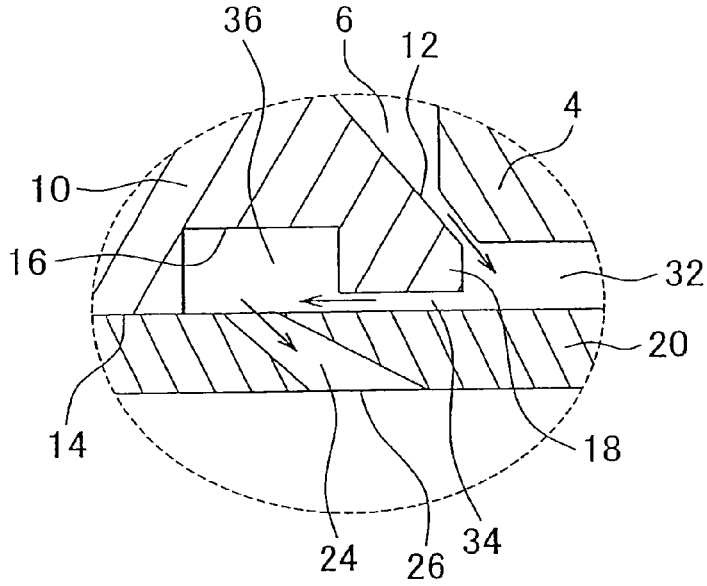
FIG. 5 is a cross sectional view showing the end portion of a fuel injection nozzle according to a third embodiment of the invention, which is similar to FIG. 2 that shows the fuel injection nozzle according to the first embodiment.

FIG. 5 is a cross sectional view showing the end portion of a fuel injection nozzle according to the third embodiment of the invention. FIG. 5 is similar to FIG. 2 in that it depicts an enlarged cross sectional view showing the oval area of the fuel injection nozzle according to the first embodiment, surrounded by the dashed line in FIG. 1. In FIG. 5, the same components and portions as those of the fuel injection nozzle according to the first embodiment are denoted by the same reference numerals. Therefore, the redundant description thereof will be omitted.

In the third embodiment, the surface of the nozzle plate 20, which faces the nozzle body 10, is flat. A protruding portion 18 is formed in the recessed portion 16 of the nozzle body 10. The protruding portion 18, which is circular, is positioned on a circle around the axis of the needle valve 4. The outer diameter of the protruding portion 18 is smaller than the diameter of the recessed portion 16. The inner diameter of the protruding portion 18 is substantially the same as the diameter of the valve seat 12. The height of the protruding portion 18 is slightly smaller than the depth of the recessed portion 16. When the nozzle plate 20 is attached to the nozzle body 10, a narrow gap is formed between the top surface of the protruding portion 18 and the nozzle plate 20.

In the third embodiment, the first cavity 32 is formed between the end of the needle valve 4 and the nozzle plate 20. The first cavity 32 is a space surrounded by the inner peripheral surface of the protruding portion 18. The second cavity 36 is formed between the nozzle body 10 and the nozzle plate 20. The second cavity 36 is a space surrounded by the peripheral surface of the recessed portion 16 and the outer peripheral surface of the protruding portion 18. The fuel passage 34 is formed by a gap between the top surface of the protruding portion 18 and the nozzle plate 20. The fuel passage 34 connects the two cavities 32 and 36 to each other.

With the above-described configuration, the nozzle plate 20 is a thin flat plate. This eliminates the need of performing a complicated forming process. Further, the height of the fuel passage 34, that is, the clearance between the attachment surface 14 and the top surface of the protruding portion 18 may be adjusted by adjusting the amount of material removed from the end of the protruding portion 18. Thus, it is possible to accurately form the narrow space needed to effectively induce cavitation.

Figure 6:
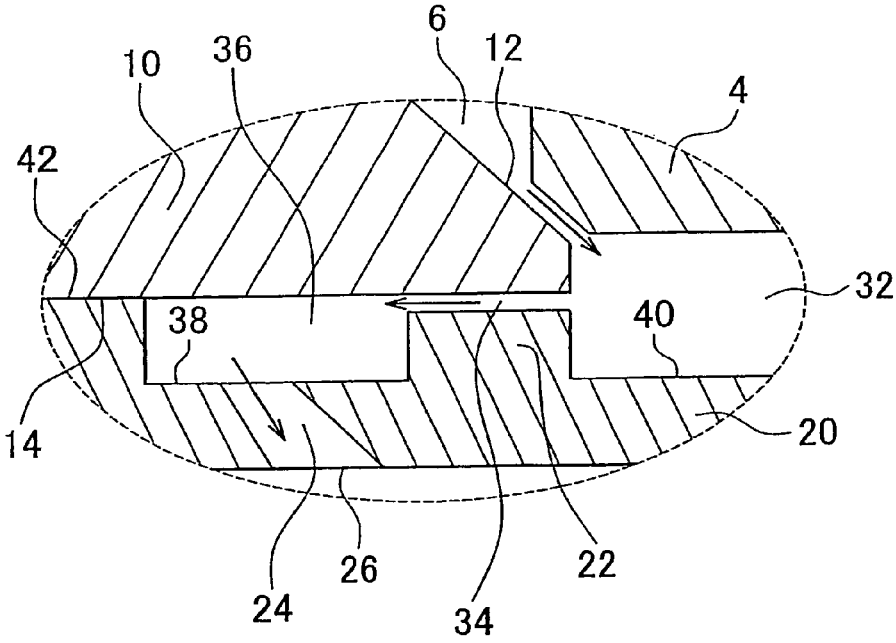
FIG. 6 is a cross sectional view showing the end portion of a fuel injection nozzle according to a fourth embodiment of the invention, which is similar to FIG. 2 that shows the fuel injection nozzle according to the first embodiment.

A fourth embodiment of the invention will be described with reference to FIG. 6. FIG. 6 is a cross sectional view showing the end portion of a fuel injection nozzle according to the fourth embodiment of the invention. FIG. 6 is similar to FIG. 2 in that it also depicts the enlarged cross sectional view showing the oval area of the fuel injection nozzle according to the first embodiment, surrounded by the dashed line in FIG. 1. In FIG. 6, the same components and portions as those of the fuel injection nozzle according to the first embodiment are denoted by the same reference numerals. Therefore, redundant description thereof will be omitted.

In the fourth embodiment, the surface of the nozzle body 10, which faces the nozzle plate 20, is flat. A circular recessed portion 38, a recessed portion 40, and a protruding portion 22 are formed in the nozzle plate 20. The protruding portion 22 is disposed between the circular recessed portion 38 and the recessed portion 40. The height of the protruding portion 22 is slightly smaller than the depth of the circular recessed portion 38. When the nozzle plate 20 is attached to the nozzle body 10, a narrow gap is formed between the top surface of the protruding portion 22 and the nozzle body 10.

In the fourth embodiment, the first cavity 32 is formed between the end of the needle valve 4 and the recessed portion 40. The circular recessed portion 38 functions as the second cavity 36. The fuel passage 34 is formed by a gap between the top surface of the protruding portion 22 and the nozzle body 10. The fuel passage 34 connects the two cavities 32 and 36 to each other.

With the above-described configuration, the surface of the nozzle body 10, which faces the nozzle plate 20, is flat. This eliminates the need of performing a complicated forming process. Further, the height of the fuel passage 34, that is, the clearance between an attachment surface 42 and the top surface of the protruding portion 22 is adjusted by adjusting the amount of material removed from the end of the protruding portion 22. Thus, it is possible to accurately form the narrow space needed to effectively induce cavitation.

While the invention has been described with reference to example embodiments thereof, it is to be understood that the invention is not limited to the described embodiments or constructions. To the contrary, various modifications may be made within the spirit and scope of the invention. For example, the configuration according to the second embodiment may be combined with the configuration according to the third embodiment.

The invention claimed is:

1. A fuel injection nozzle comprising:

a plurality of injection outlets;

a valve seat, formed in a passage through which fuel flows to the plurality of injection outlets;

a needle valve that is seated on, or moved away from, the valve seat;

a first cavity disposed downstream of the valve seat in a direction in which the fuel flows;

a second cavity disposed downstream of the first cavity in the direction in which the fuel flows;

a first fuel passage that connects the first cavity to the second cavity, wherein a first flow passage area of the first fuel passage is smaller than a second flow passage area of the first cavity; and a plurality of second fuel passages, each of which connects the second cavity to a corresponding one of the plurality of injection outlets, wherein a third flow passage area of each of the plurality of second fuel passages is smaller than a fourth flow passage area of the second cavity, wherein each of the plurality of second fuel passages is inclined with respect to a direction perpendicular to a direction in which the first fuel passage extends such that a downstream side of each of the plurality of second fuel passages is closer to an upstream side of the first fuel passage than an upstream side of each of the plurality of second fuel passages and each side of each of the plurality of second fuel passages (1) is inclined in a direction toward the first fuel passage and (2) diverges from each other, the first cavity is disposed on an axis of the needle valve, the second cavity is disposed along a circle around the axis of the needle valve, and the first fuel passage extends from a peripheral surface of the first cavity in a radial direction of the needle valve, the needle valve further comprises:

a nozzle body in which the needle valve is housed and in which the valve seat is formed; and a nozzle plate in which the plurality of injection outlets are formed, the first cavity is formed by a first gap between the needle valve and the nozzle plate, the first fuel passage and the second cavity are formed by a second gap between the nozzle body and the nozzle plate, the plurality of second fuel passages is formed in the nozzle plate, the second gap is disposed along the circle around the axis of the needle valve, the second gap includes a narrow gap, and a wide gap that is wider than the narrow gap, and the wide gap is disposed outside the narrow gap in the radial direction, the first fuel passage is formed by the narrow gap, and the second cavity is formed by the wide gap, and the second gap is formed either by a first recessed portion and a first protruding portion that are formed on a surface of the nozzle body, which faces the nozzle plate or by a second recessed portion and a second protruding portion that are formed on a surface of the nozzle plate facing the nozzle body.

2. The fuel injection nozzle according to claim 1, wherein the narrow gap is continuously formed along the circle around the axis of the needle valve.

3. The fuel injection nozzle according to claim 2, wherein the wide gap is continuously formed along the circle around the axis of the needle valve.

4. The fuel injection nozzle according to claim 1, wherein the wide gap is radially separated into a plurality of wide gaps that are disposed at predetermined intervals along the circle around the axis of the needle valve, and each of the plurality of wide gaps is connected to at least one of the plurality of injection outlets via a corresponding one of the plurality of second fuel passages.

5. The fuel injection nozzle according to claim 1, wherein the fuel flows through the first cavity, the first fuel passage, the second cavity, and the second fuel passage, in the stated order, before reaching the plurality of injection outlets, and the fuel is injected from the plurality of injection outlets.

6. The fuel injection nozzle according to claim 1, wherein the wide gap is continuously formed along the circle around the axis of the needle valve.

* * * * *